US009470195B2

(12) United States Patent
Teets et al.

(10) Patent No.: US 9,470,195 B2
(45) Date of Patent: Oct. 18, 2016

(54) FUEL SUPPLY SYSTEM WITH ACCUMULATOR

(71) Applicants: Michael R Teets, Grosse Pointe Park, MI (US); Joseph B Adams, Northville, MI (US); Thomas A Sharp, South Lyon, MI (US); Regina M Cook, Chesterfield, MI (US); Paul J Fitzgerald, Troy, MI (US); Russell J Wakeman, Canton, MI (US); John R Jaye, Northville, MI (US); Glen E Tallarek, Grosse Pointe Woods, MI (US); Paul J Luft, Novi, MI (US)

(72) Inventors: Michael R Teets, Grosse Pointe Park, MI (US); Joseph B Adams, Northville, MI (US); Thomas A Sharp, South Lyon, MI (US); Regina M Cook, Chesterfield, MI (US); Paul J Fitzgerald, Troy, MI (US); Russell J Wakeman, Canton, MI (US); John R Jaye, Northville, MI (US); Glen E Tallarek, Grosse Pointe Woods, MI (US); Paul J Luft, Novi, MI (US)

(73) Assignee: FCA US LLC, Auburn Hills, MI (US)

( * ) Notice: Subject to any disclaimer, the term of this patent is extended or adjusted under 35 U.S.C. 154(b) by 0 days.

(21) Appl. No.: 14/840,291

(22) Filed: Aug. 31, 2015

(65) Prior Publication Data

US 2015/0369189 A1 Dec. 24, 2015

Related U.S. Application Data

(63) Continuation-in-part of application No. 13/718,474, filed on Dec. 18, 2012, now abandoned.

(51) Int. Cl.

| | |
|---|---|
| ***F02M 37/00*** | (2006.01) |
| ***F02M 55/04*** | (2006.01) |
| ***F02M 69/18*** | (2006.01) |
| ***F02M 69/46*** | (2006.01) |
| ***F02M 69/54*** | (2006.01) |

(52) U.S. Cl.

CPC ..... *F02M 55/04* (2013.01); *F02M 37/0041* (2013.01); *F02M 37/0052* (2013.01); *F02M 69/18* (2013.01); *F02M 69/465* (2013.01); *F02M 69/54* (2013.01); *F02M 2200/40* (2013.01); *F02M 2200/60* (2013.01)

(58) Field of Classification Search

CPC ..... F02M 63/0225; F02M 63/023; F02M 37/0005; F02M 37/0041; F02M 37/0052; F02M 2041/1477

USPC ..... 123/445, 446, 447, 457, 458, 510, 511, 123/514, 495; 701/103, 104; 138/26, 31

See application file for complete search history.

(56) References Cited

U.S. PATENT DOCUMENTS

| | | | |
|---|---|---|---|
| 4,572,136 | A | 2/1986 | Takeuchi et al. |
| 4,884,545 | A | 12/1989 | Mathis |
| 5,133,645 | A | 7/1992 | Crowley et al. |
| 5,186,147 | A | 2/1993 | Bellis |
| 5,590,631 | A | 1/1997 | Tuckey |

(Continued)

FOREIGN PATENT DOCUMENTS

| | | |
|---|---|---|
| WO | 2009/152876 | 12/2009 |

*Primary Examiner* — Lindsay Low
*Assistant Examiner* — Robert Werner
(74) *Attorney, Agent, or Firm* — Ralph E. Smith

(57) ABSTRACT

A fuel supply system with an accumulator that allows for the accumulation of fuel at a pressure greater than the nominal operating pressure of the fuel supply system. The accumulation of fuel allows for less frequent fuel pump operation and therefore a reduction in overall fuel consumption of an engine.

14 Claims, 1 Drawing Sheet

(56) References Cited

U.S. PATENT DOCUMENTS 5,701,869 A * 12/1997 Richardson ..... F02D 41/3082 123/447
5,762,046 A * 6/1998 Holmes ..... F02D 41/3082 123/497
5,765,535 A * 6/1998 Radermacher ..... F02M 37/08 123/456
6,325,048 B1 * 12/2001 Robinson ..... F02M 69/462 123/456
6,376,927 B1 * 4/2002 Tamai ..... B60K 6/383 290/31
6,497,215 B1 * 12/2002 Gaessler ..... F02M 59/18 123/179.16
6,532,938 B1 3/2003 Mahr et al.
6,951,206 B2 10/2005 Kishimoto
7,861,691 B2 1/2011 Nakata et al.
2003/0192508 A1 10/2003 Kishimoto
2004/0187848 A1 9/2004 Hlousek
2006/0042597 A1 3/2006 Magel
2012/0136555 A1 * 5/2012 Okamoto ..... F02D 41/047 701/104
2015/0159644 A1 * 6/2015 Jonas ..... F02D 41/3836 417/44.2

* cited by examiner

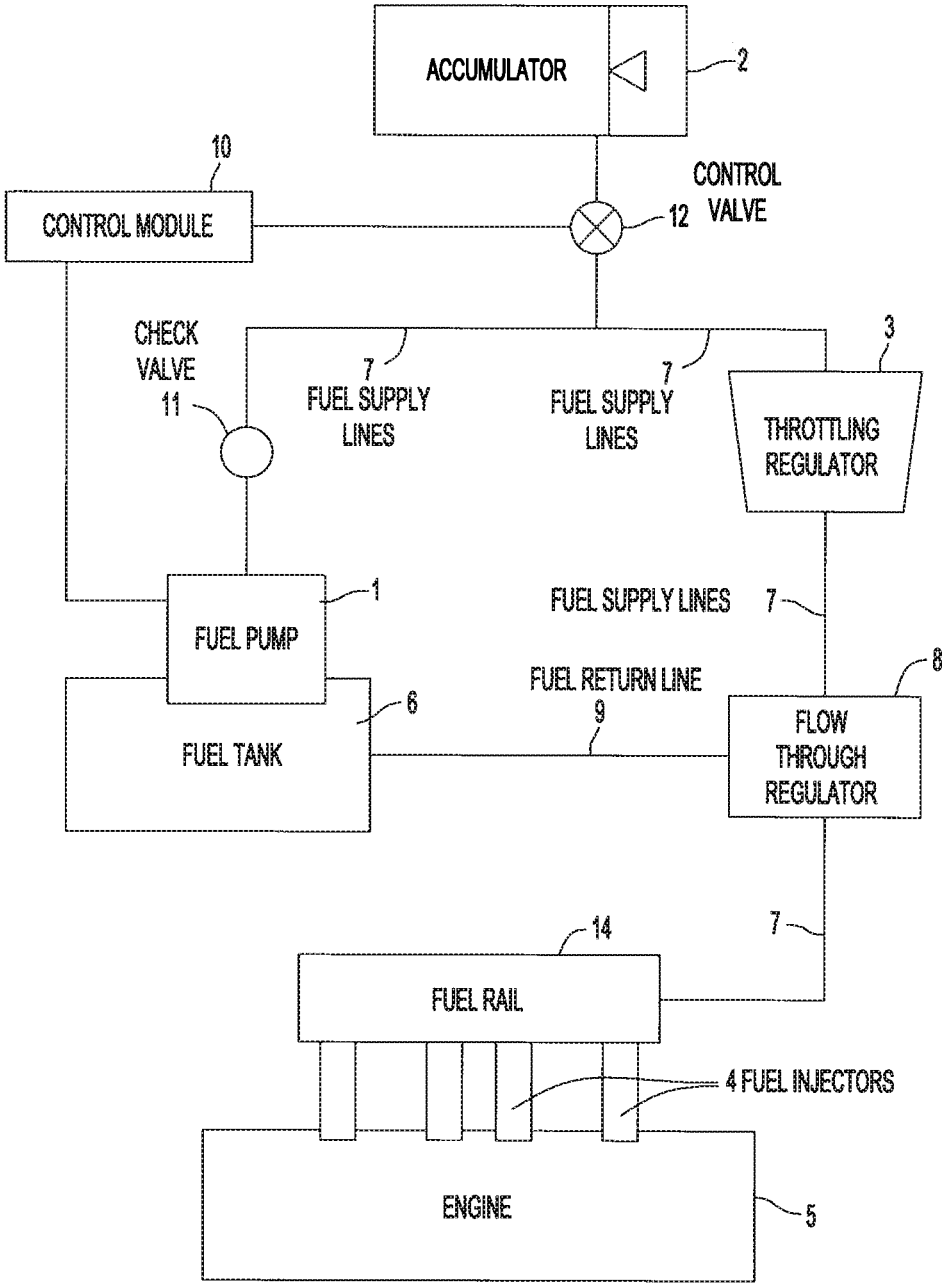
ACCUMULATOR
2
10
CONTROL MODULE
CONTROL VALVE
12
CHECK VALVE
11
7
FUEL SUPPLY LINES
7
FUEL SUPPLY LINES
3
THROTTLING REGULATOR
FUEL PUMP
1
FUEL SUPPLY LINES
7
FUEL RETURN LINE
9
8
6
FUEL TANK
FLOW THROUGH REGULATOR
7
14
FUEL RAIL
4 FUEL INJECTORS
ENGINE
5

FUEL SUPPLY SYSTEM WITH ACCUMULATOR

CROSS-REFERENCE TO RELATED APPLICATIONS

This application is a continuation-in-part of U.S. patent application Ser. No. 13/718,474 filed on Dec. 18, 2012. The entire disclosure of the above application is incorporated herein by reference.

FIELD

The present application relates to a fuel supply system, and more particularly, to a fuel supply system with an accumulator utilized to increase fuel efficiency.

BACKGROUND

A typical fuel supply system for an internal combustion engine includes a fuel pump that conveys fuel being stored in a fuel tank through a fuel supply line to a fuel injector on the engine. As the engine operates, the fuel pump is activated to provide a continuous supply of fuel to the engine. However, an engine's fuel consumption varies greatly with its required output. More fuel is required during times of higher engine demand and less fuel during times of lesser engine demand, or during idling. In order to ensure that the engine is always provided with adequate fuel, the fuel pump is typically designed to provide fuel to the engine at the rate required for maximum engine output. Therefore, during times of less-than maximum engine output, the fuel pump delivers excess fuel to the system. It is common for a fuel supply system to include a flow-through regulator to ensure that only the required amount of fuel is provided to the engine, and to allow for any excess fuel provided to the fuel supply line to be returned to the fuel tank by means of a fuel return line.

With the fuel pump designed to provide fuel to meet the requirements of the engine when operating at maximum output, electrical energy is consumed wastefully by the pump during times of non-peak engine output. During these non-peak times, the fuel pump is providing excess fuel to the fuel supply system which is then returned to the fuel tank via the flow-through regulator and fuel return line. Accordingly, there is a need for improvement in the relevant art.

SUMMARY

The present application provides a fuel supply system that includes an accumulator disposed in fluid communication with the fuel pump and the engine. The accumulator allows for fuel to be accumulated within the fuel supply system when the fuel pump is activated. Excess fuel provided by the fuel pump during times of non-peak engine output is stored within the accumulator and later utilized by the engine rather than being returned to the tank through the flow-through regulator and return line. Allowing for the accumulation of fuel within the accumulator rather than returning the excess fuel to the tank permits the fuel pump to be operated less frequently then in a typical fuel supply system. This reduces the expenditure of electrical power to operate the fuel pump, and in-turn increases the fuel economy of the engine by requiring less electrical current to be drawn from a vehicle's electrical system.

Thus, a fuel supply system that reduces the wasted electrical energy consumed by the fuel pump when the engine is operating at less-than maximum output is provided.

Further areas of applicability of the present disclosure will become apparent from the detailed description provided hereinafter. It should be understood that the detailed description, including disclosed embodiments and drawings, are mere exemplary in nature intended for purposes of illustration only and are not intended to limit the scope of the invention, its application or use. Thus, variations that do not depart from the gist of the invention are intended to be within the scope of the invention.

BRIEF DESCRIPTION OF THE DRAWINGS

FIG. 1 is a schematic diagram showing an overview of an exemplary automotive fuel supply apparatus according to the principles of the present disclosure.

DETAILED DESCRIPTION

FIG. 1 is a schematic representation of an exemplary fuel supply system according to the principles of the present disclosure. Embodiments of the invention disclosed herein minimize wasted electrical energy consumed by the fuel pump when the engine is operating at less-than maximum output. The fuel supply system includes a fuel pump 1 providing fuel to the fuel supply system from a fuel tank 6. The fuel pump is in fluid communication with an accumulator 2, a throttling regulator 3, a flow-through regulator 8, and at least one fuel injector 4 on an engine 5. In one embodiment, the fluid communication within the fuel supply system is provided by fuel supply lines 7.

The fuel pump 1 is equipped with an electrical motor that draws current from the vehicle's electrical system in order to operate. Typically, a battery for the storage of electrical energy and an alternator for converting mechanical energy supplied by the engine into electrical energy are also provided within the vehicle's electrical system. A reduction in the fuel pump's frequency of operation leads to a reduction in current draw from the electrical system. This in-turn requires the alternator to convert less mechanical energy generated by the engine into electrical energy.

The accumulator 2 may be any type of accumulator, including, but not limited to, a compressed gas accumulator, a spring type accumulator, or a metal bellows type accumulator. The accumulator 2 is configured to fill with fuel after the pressure within the fuel supply line 7 exceeds a nominal operating pressure of the fuel supply system. The nominal operating pressure of the fuel supply system is the pressure required to ensure that adequate fuel is supplied to the fuel injectors 4 so that the engine 5 operates efficiently. In one exemplary implementation, the accumulator 2 is configured to fill with fuel only after a pressure of the fuel supply system between the fuel pump 1 and the throttling regulator 3 exceeds the nominal operating pressure of the fuel supply system.

For example, if the nominal operating pressure is 57 p.s.i., the accumulator 2 of the present system will start to fill at pressures exceeding 57 p.s.i. This ensures that on engine restarts, or other conditions where the accumulator 2 may be depleted of fuel, pumped fuel is preferentially directed to the engine 5 before filling the accumulator 2 to allow the engine 5 to start and/or run correctly; rather than filling the accumulator 2 while starving the engine 5 of fuel or providing for an excessive flow of fuel to accommodate both the accumulator 2 and the engine 5, which is inefficient and reduces fuel economy. In one exemplary implementation, the fuel pump is configured to supply fuel to the at least one fuel injector 4 independent of the accumulator 2, such as when the pressure in the fuel supply system between the throttling regulator 3 and the fuel pump 1 is at or not above the nominal operating pressure.

In one exemplary aspect of the invention, the accumulator 2 is equipped with a shutoff valve 12, such as a control or solenoid shut off valve that is configured to isolate the fuel system from flow in or out of the accumulator 2. This solenoid valve 12, which is controlled by the engine control module 10, is used, for example, in the event of a potential vehicle safety issue (such as a vehicle impact event) in which there might be damage to the vehicle fuel system. In such a potential scenario, the engine control module 10 would use indications such as airbag deployment or unexpected engine stalling to close the solenoid shutoff valve 12 to contain the volume of fuel stored in the accumulator 2 under pressure. In the location shown, the solenoid valve 12 isolates the entire fuel system from the accumulator 2, rather than just the engine portion or just a portion of the fuel system.

The throttling regulator 3 allows for a substantially constant supply of fuel to the engine 5 at approximately the nominal operating pressure regardless of pressure variations above the nominal operating pressure at the inlet of the throttling regulator 3. The throttling regulator 3 is preferably of an intake manifold pressure referenced type, rather than a regulator referenced to atmospheric pressure. With the regulator referenced to manifold pressure, the gauge fuel pressure (relative to atmosphere) varies with the variation of manifold pressure, keeping the delta pressure across the injector constant regardless of operating condition. This feature extends the linear flow range of the injector, improving metering accuracy.

The inlet of the throttling regulator 3 is in fluid communication with the accumulator 2, and the outlet of the throttling regulator 3 is in fluid communication with a fuel rail 14 that is in communication with and coupled to the fuel injectors 4 of the engine 5. The throttling regulator 3 is preferably positioned between the accumulator 2 and a fuel rail 14 allowing for higher fuel pressures to be present between the fuel pump 1 and the inlet of the throttling regulator 3, while maintaining a supply of fuel to the fuel injectors 4 (via the fuel rail 14) of the engine 5 at approximately the nominal operating pressure. By design the throttling regulator 3 is opened when the pressure in the fuel rail 14 is below the target value, allowing the accumulator system 2 to raise the fuel rail 14 pressure. When the pressure in fuel rail 14 is at or above the desired target value, the regulator 3 is closed, allowing no flow in or out of the fuel rail 14. With this configuration, fuel is accumulated within the accumulator 2 at a pressure greater than the nominal injector 4 operating pressure, while fuel supplied to the engine 5 is at approximately the nominal injector 4 operating pressure.

The flow-through regulator 8 protects the fuel injectors 4 from overpressure events which cause metering errors or fuel leakage into the engine (with performance and emission penalties), and therefore is set to relieve pressure within the fuel rail 14 at a threshold higher than the nominal injector 4 operating pressure. The flow-through regulator 8 is preferably positioned between the throttling regulator 3 and the fuel rail 14/fuel injectors 4 on the engine 5, since the throttling regulator 3 is unable to relieve fuel rail pressure back to the accumulator system 2 when it rises above the nominal injector 4 operating pressure. Excess fuel is returned only during overpressure events (e.g., hot soaks) by the flow-through regulator 8 to the fuel tank 6 through a fuel return line 9. In this manner, placement of the flow-through regulator downstream of the throttling regulator 3 (and thus accumulator 2) and upstream of the fuel rail 14 and injectors 4, provides for relieving pressure at the fuel rail 14 at a pressure higher than the nominal operating pressure while advantageously not affecting the accumulator pressure.

A check valve 11 is provided so as to prevent fuel supplied to the fuel supply system from returning to the fuel tank 6 through the fuel pump 1 when the fuel pump 1 is not in operation. The check valve 11 also allows the fuel supply system to remain pressurized when the fuel pump 1 is not activated.

During operation, a control module 10 monitors and controls the fuel pump 1, and can activate and deactivate the fuel pump 1 so as to maintain a pressure in the accumulator higher than the nominal fuel injector 4 operating pressure, to insure a constant supply of fuel to the engine 5. In one embodiment of the present invention, the control module 10 monitors a current draw from the electrical motor of the fuel pump 1 as an indication of the outlet pressure at which the pump 1 is operating, without the need for a pressure sensor in the system. When the current draw reaches a predetermined value, the control module 10 deactivates the fuel pump 1. The predetermined current draw value at which the fuel pump 1 is deactivated can be fixed or variable.

For example, the predetermined pump current draw value can be calculated using an established characteristic curve of pump motor current draw in relation to accumulator pressure and fuel flow to the engine 5. Initial pressure of the accumulator 2 is calculated using the known relationship of accumulator fill volume and accumulator pressure. During a previous pumping event, the accumulator 2 was filled to full capacity, i.e. a known pressure characteristic of the accumulator 2. After this initial condition is set in the engine controller 10, fuel consumed by the engine 5 is totalized by a calculation using injector flow rate, pulsewidth, and frequency. This total of fuel consumed by the engine 5 corresponds to volume of fuel exiting the accumulator 2. In this way, current accumulator fill volume can be calculated, along with the accumulator pressure that corresponds to this state of fill based on known accumulator characteristics.

When a predetermined low pressure/fill threshold is reached, the pump 1 is energized. During this time pump input power (current times voltage to the pump) is calculated, and this power corresponds to fluid pumping power (pressure times flow). With the pressure known from the previous calculation, pumping power can be used to calculate pump flow. However, since the engine 5 is still consuming fuel, the pump 1 flow must be divided into engine 5 flow and flow into the accumulator 2. This is again done using injector flow rate, pulsewidth, and frequency. Total pump flow less engine flow is flow into the accumulator. This flow is totalized by the engine controller 10, and when an amount has been delivered to the accumulator 2 which fills it completely, the pump is turned off and the cycle repeats.

In another aspect of the invention, a pressure sensor within the fuel supply system provides accumulator pressure data to the control module 10. When the pressure reaches a predetermined value, the control module 10 deactivates the fuel pump 1. In yet another embodiment of the present invention, the fuel pump 1 is supplied with a low cost pressure switch to replace the function of an analog accumulator pressure sensor, eliminating the cost of the sensor.

This switch can be directly in control of the voltage supply to the pump with no intervention from the engine control module, or preferably can be an input to the engine management controller so that switch closure as pressure rises (and later switch opening as pressure falls) is one of several inputs to the pump control algorithm, which then can be more complex than a simple pressure threshold.

In yet another embodiment of the present invention, the control module 10 calculates the time it takes the pump 1 to fill the accumulator 2 with fuel from its current calculated state of fill, and activates the pump for this predetermined time. The control module 10 deactivates the fuel pump 1 once this predetermined time has elapsed since the fuel pump 1 was last activated. This predetermined time can be a function of the calculated or measured amount of fuel consumed by the engine since the accumulator was last filled, to minimize the amount of time that the pump is activated. Specifically, the level of engine demand can be measured or calculated by the control module 10. The control module 10 can then calculate the amount of fuel being consumed in comparison to the amount of fuel being stored in the accumulator 2, and adjust the predetermined pump activation time accordingly. For example, when the engine is idling, the predetermined pump activation time is relatively short in comparison to times of high engine demand.

The calculated state of fill of the accumulator 2 is an indication of the accumulator pressure, since the pressure of the fluid side of any accumulator rises directly as the elastic medium of the accumulator is compressed by filling. The ability to calculate accumulator pressure from pump 1 and engine 5 operating parameters already known by the control module 10 eliminates the need for other pressure sensors, volume sensors, or switches. With the accumulator filled to its maximum capacity by suitably long pump activation, the volume of fuel remaining in the accumulator 2 can be known with some certainty by calculating fuel flow into the engine, using injector pulsewidth and engine speed.

In yet another aspect of the invention, the control module 10 monitors the engine fueling correction required to maintain a desired measured exhaust gas oxygen output of the vehicle while in operation. This fueling correction is an indication of the delivery rate of the injectors 4, which in turn is a direct function of the pressure applied by the fuel system. When the correction required to maintain a desired exhaust gas oxygen output (i.e. engine air/fuel ratio) reaches a predetermined value, the control module 10 deactivates the fuel pump 1.

While the fuel pump is deactivated, the accumulator 2 is pressurized with fuel at a pressure greater than that required for engine operation, allowing the accumulator 2 to continue to supply adequate fuel to the engine 5 through the throttling regulator 3. The fuel pump 1 is once again activated when fuel stored within the accumulator 2 has decreased below a predetermined volume or equivalently a predetermined pressure.

In one embodiment of the present invention, a pressure sensor within the fuel supply system provides pressure data to the control module 10. When the pressure falls to a predetermined value, the control module 10 reactivates the fuel pump 1. In another embodiment of the present invention, the fuel pump 1 is supplied with a pressure switch. The pressure switch reactivates the fuel pump 1 once the pressure within the fuel supply system falls to a predetermined value. The pressure at which the pump is activated may be a constant value, or may be altered in relation to engine demand and the rate of fuel consumption.

In yet another aspect of the invention, the accumulator 2 is equipped with a volume sensor that provides data to the control module 10. When the accumulator volume falls to a predetermined value, the control module 10 reactivates the fuel pump 1. In yet another aspect of the invention, the control module 10 monitors the number and duration of fuel injector pulses to calculate the amount of fuel used by the engine since the accumulator 2 was last filled with fuel. When the fuel output from the accumulator reaches a predetermined amount, the control module 10 reactivates the fuel pump 1.

In addition, the control module 10 activates the fuel pump 1 when the engine 5 is in a reverse power state. A reverse power state is a state when the electrical energy needed to operate the fuel pump 1 can be obtained from the vehicle's electrical system with little or no additional fuel energy from the engine 5 being expended, or conditions where the vehicle's inertia reverses torque in the drivetrain to motor the engine with little or no consumption of fuel energy. Reverse power states include, but are not limited to, times when the vehicle is decelerating, coasting, or descending a hill. Typical of engine control during these states is a fuel injection strategy which reduces or stops delivery to the engine 5. By operating the fuel pump 1 when the engine 5 is in a reverse power state, the accumulator 2 can be filled with fuel pumped by using alternator power derived from vehicle kinetic energy spinning the engine (and so the alternator) to drive the electric fuel pump 1. Under some vehicle operating duty cycles (e.g. city traffic) with frequent decelerations it is possible to power the fuel pump 1 exclusively during vehicle decelerations with the fuel injectors 4 shut off. Less fuel energy is thus expended by the engine 5, thus leading to a further increase in fuel efficiency.

Depending on the requirements and physical dimensions of the components of the fuel supply system, the components can be arranged in any fashion that allows for adequate operation of the system. As such, the fuel pump 1, the accumulator 2, the throttling regulator 3, and the flow-through regulator 8 can preferably be contained within the fuel tank 6. Containment within the fuel tank 6 is an advantage since fuel leaked or permeated from the system components is contained within the fuel tank 6, reducing safety hazards and regulated evaporative fuel emissions.

The disclosed fuel supply system therefore allows for adequate fuel to be supplied to the engine 5, while conserving energy and reducing fuel consumption. The accumulator 2 allows for fuel to be accumulated within the fuel supply system so that the fuel pump 1 is operated less frequently. Because the accumulator 2 is configured to fill with fuel after the pressure within the fuel supply line exceeds a nominal operating pressure, fuel is provided to the engine more quickly upon initial startup, allowing for faster and more reliable engine starts. In addition, operating the fuel pump 1 to fill the accumulator 2 when the engine 5 is in a reverse power state further increases fuel efficiency.

It will be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. A fuel supply system, comprising:

a fuel pump and at least one fuel injector;

a throttling regulator in fluid communication with the fuel pump and configured to provide fuel pressure at a nominal operating pressure of the fuel supply system at the at least one fuel injector;

a flow-through regulator positioned between and in fluid communication with the throttling regulator and the at least one fuel injector;

an accumulator positioned between and in fluid communication with the fuel pump and the throttling regulator, the accumulator being a spring-type or compressed gas-type accumulator configured to accumulate fuel at an accumulator pressure, which is greater than the nominal operating pressure;

wherein the throttling regulator is positioned between the accumulator and the flow-through regulator, the throttling regulator configured to provide fuel pressure at or above the accumulator pressure between the fuel pump and the throttling regulator while maintaining a supply of fuel to the at least one fuel injector at the nominal operating pressure thereby providing for the accumulator to fill after fuel pressure between the fuel pump and the throttling regulator is at or above the accumulator pressure, and wherein the flow-through regulator is configured to selectively provide pressure relief when fuel pressure in the fuel supply system at the at least one fuel injector is greater than the nominal operating pressure; and a control module connected to the fuel pump for monitoring and controlling operation of the fuel pump, wherein the control module monitors a current draw of the fuel pump as an indication of an outlet pressure of the fuel pump to control operation of the fuel pump without requiring a pressure sensor, and wherein current draw values at which the fuel pump is deactivated vary in relation to accumulator pressure.

2. The fuel supply system according to claim 1, wherein the accumulator is configured to fill only after fuel pressure between the fuel pump and the throttling regulator is at or above the accumulator pressure such that the fuel pump is configured to supply fuel to the at least one fuel injector independent of the accumulator.

3. The fuel supply system according to claim 1, wherein the throttling regulator is configured to provide for the accumulator to fill only after fuel pressure between the fuel pump and the throttling regulator exceeds the nominal operating pressure of the fuel supply system.

4. The fuel supply system according to claim 3, wherein the flow-through regulator is configured to selectively provide pressure relief when fuel pressure at the at least one fuel injector is greater than the nominal operating pressure and while not relieving pressure of the fuel supply system upstream of the throttling regulator.

5. The fuel supply system of claim 4, wherein the throttling regulator is an intake manifold referenced type regulator such that a gauge of fuel pressure varies with a variation of manifold pressure.

6. The fuel supply system according to claim 3, further comprising an accumulator shut off valve in communication with the accumulator, the shut off valve configured to selectively isolate the accumulator from a remainder of the fuel supply system.

7. The fuel supply system according to claim 1, further comprising a pressure sensor connected to the control module, wherein the control module monitors a pressure within the fuel supply system to control operation of the fuel pump; and wherein the pressure values at which the pump is activated and deactivated vary in relation to engine fuel consumption.

8. The fuel supply system according to claim 1, further comprising a pressure switch connected to the fuel pump, wherein the pressure switch controls operation of the fuel pump.

9. The fuel supply system according to claim 1, further comprising a volume sensor connected to the accumulator and control module, wherein the control module monitors the volume of fuel within the accumulator to control operation of the fuel pump.

10. The fuel supply system according to claim 1, wherein the control module calculates the amount of fuel within the accumulator and the required pump activation time to fill the accumulator in its current state to control the operation of the fuel pump.

11. The fuel supply system according to claim 1, wherein the control module monitors engine fueling correction required to maintain a desired exhaust gas oxygen output of the vehicle to control operation of the fuel pump.

12. The fuel supply system according to claim 1, wherein the control module monitors a number and duration of fuel injector pulses to control operation of the fuel pump.

13. The fuel supply system according to claim 1, wherein the control module activates the fuel pump preferably during a reverse power state.

14. A fuel supply system, comprising:

a fuel pump and at least one fuel injector;

a throttling regulator in fluid communication with the fuel pump and configured to provide fuel pressure at a nominal operating pressure of the fuel supply system at the at least one fuel injector, the throttling regulator configured to open when the pressure at the at least one fuel injector is below the nominal operating pressure, and close when the pressure at the at least one fuel injector is at or above the nominal operating pressure;

a flow-through regulator positioned between and in fluid communication with the throttling regulator and the at least one fuel injector;

an accumulator positioned between and in fluid communication with the fuel pump and the throttling regulator, the accumulator being a spring-type or compressed gas-type accumulator configured to accumulate fuel at an accumulator pressure, which is greater than the nominal operating pressure;

wherein the throttling regulator is positioned between the accumulator and the flow-through regulator, the throttling regulator configured to provide fuel pressure above the accumulator pressure between the fuel pump and the throttling regulator while maintaining a supply of fuel to the at least one fuel injector at the nominal operating pressure thereby providing for the accumulator to fill after fuel pressure between the fuel pump and the throttling regulator is at or above the accumulator pressure, and wherein the flow-through regulator is configured to selectively provide pressure relief at a location between the throttling regulator and the at least one fuel injector when fuel pressure in the fuel supply system at that location is greater than the nominal operating pressure; and a control module connected to the fuel pump for monitoring and controlling operation of the fuel pump, wherein the control module monitors a current draw of the fuel pump as an indication of an outlet pressure of the fuel pump to control operation of the fuel pump without requiring a pressure sensor, and wherein current draw values at which the fuel pump is deactivated vary in relation to accumulator pressure.

* * * * *